United States Patent [19]

Palmer

[11] Patent Number: 4,803,753

[45] Date of Patent: Feb. 14, 1989

[54] SELF-PROPELLED CARPET SCRUBBING MACHINE

[75] Inventor: Gary E. Palmer, Roselle, Ill.

[73] Assignee: Hako Minuteman, Inc., Addison, Ill.

[21] Appl. No.: 110,130

[22] Filed: Oct. 19, 1987

[51] Int. Cl.[4] ..... A47L 7/00

[52] U.S. Cl. ..... 45/320; 15/359

[58] Field of Search ..... 15/50 C, 50 R, 320, 15/321, 340, 353, 98, 354, 359, 360

[56] References Cited

U.S. PATENT DOCUMENTS

| | | | |
|---|---|---|---|
| 3,065,490 | 11/1962 | Arones | 15/359 |
| 4,000,536 | 1/1977 | Nayfa et al. | 15/320 |
| 4,041,567 | 8/1977 | Burgoon | 15/320 |
| 4,196,492 | 4/1980 | Johnson et al. . | |
| 4,210,978 | 7/1980 | Johnson et al. . | |
| 4,334,335 | 6/1982 | Brown et al. | 15/320 |
| 4,380,844 | 4/1983 | Waldhauser et al. | 15/359 |
| 4,483,041 | 11/1984 | Waldhauser et al. | 15/320 |
| 4,500,113 | 2/1985 | Law | 280/716 |
| 4,586,208 | 5/1986 | Trevarthen . | |

*Primary Examiner*—Harvey C. Hornsby
*Assistant Examiner*—Corinne M. Reinckens
*Attorney, Agent, or Firm*—Emrich & Dithmar

[57] ABSTRACT

A self-propelled carpet scrubbing machine includes a solution tank for storing cleaning solution and a recovery tank for storing the dirty recovered solution. The machine is front-wheel driven and includes a rear axle which is mounted by means of a resilient member which permits it to rock about a central axis extending in the direction of travel to insure that all four wheels, and principally the drive wheels, are in contact at all times with the surface being cleaned. A vacuum recovery assembly is mounted by cushioned spring assemblies which permit the vacuum recovery assembly to rock upwardly thereby permitting the machine to be operated in reverse, without having to raise the assembly. When the machine is then returned to forward motion, the vacuum recovery assembly rotates back to the normal use position. The scrub brush is adjustable relative to the height of the carpet being cleaned whereas the vacuum shoe is always maintained in the same position relative to the carpet and under uniform pressure for more efficient and reliable recovery of the spent solution.

8 Claims, 3 Drawing Sheets

SELF-PROPELLED CARPET SCRUBBING MACHINE

FIELD OF THE INVENTION

The present invention relates to self-propelled carpet scrubbing machines; and in particular, it relates to a carpet scrubbing machine which has its own drive system and, behind the rear wheels, there is an assembly which sprays a cleaning solution on the carpet, followed by a rotary driven brush to clean the carpet, and then by a recovery shoe which is under vacuum so that the spent (i.e. dirty) solution and loosened dirt are suctioned into the machine. After the machine has traversed a given area, it leaves the carpet not only clean but dry to the extent that the spent solution has been recovered by the vacuum system.

Self-propelled machines of this type operate in forward and reverse directions under their own motive power. In the forward mode, a downward force is exerted on the vacuum recovery assembly to ensure proper operation of the vacuum shoe in recovering as much of the spend solution and debris as possible. The structure of prior commercial machines of this type is such that it is not possible to operate the machine in a reverse mode without raising the vacuum recovery assembly in order to avoid damage to the machine or the carpet due to binding of the vacuum shoe against the carpet when the machine is operated in reverse with the vacuum recovery assembly in its lowered, operating position. Raising the vacuum recovery system for operation in reverse requires that the vacuum recovery assembly then be lowered before it can operate in the forward mode. The process of raising and lowering the vacuum recovery assembly for minor maneuvers in reverse is time-consuming and irritating to an operator, and leads to a greater possibility that the operator may not follow the desired procedure.

SUMMARY OF THE INVENTION

The front wheels of the machine of the instant invention are driven by a motor, and there is a differential provided in the front axle to permit the machine to turn fairly sharp corners. The rear axle is mounted only at its center to the bottom of the chassis of the machine; and a cushion of flexible, resilient material such as neoprene is inserted between the rear axle and the lower surface of the chassis at the mounting so that the rear axle assembly may rotate or rock slightly about a horizontal axis extending in the direction of travel. This permits all four wheels to engage the floor even though the machine may encounter irregularities in the floor, and it insures that the two driven front wheels will always be in contact with the floor thereby providing continuous traction for the machine.

Behind the rear wheels there is a scrub brush and vacuum recovery shoe assembly (called a "vacuum recovery" assembly for short) which is mounted by a cushion spring mount system which permits the vacuum recovery assembly to be tilted forwardly and upwardly at its base or carpetengaging portion when the scrub machine is operated in a reverse mode. Heretofore, because of the desire to maintain constant pressure on the vacuum recovery shoe during forward operation, it was necessary to raise the vacuum shoe assembly completely off the floor in order to operate a machine in reverse and then lower it again to the use position for cleaning action in the forward direction. The present invention overcomes this disadvantage of having to raise the vacuum recovery assembly including the brush for operation in reverse while insuring a constant pressure on the vacuum shoe during forward operation and permitting adjustment of the elevation of the scrub brush relative to the bottom of the vacuum shoe. This permits the brush to be adjusted for carpets of different pile while maintaining uniform pressure on the recovery shoe.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
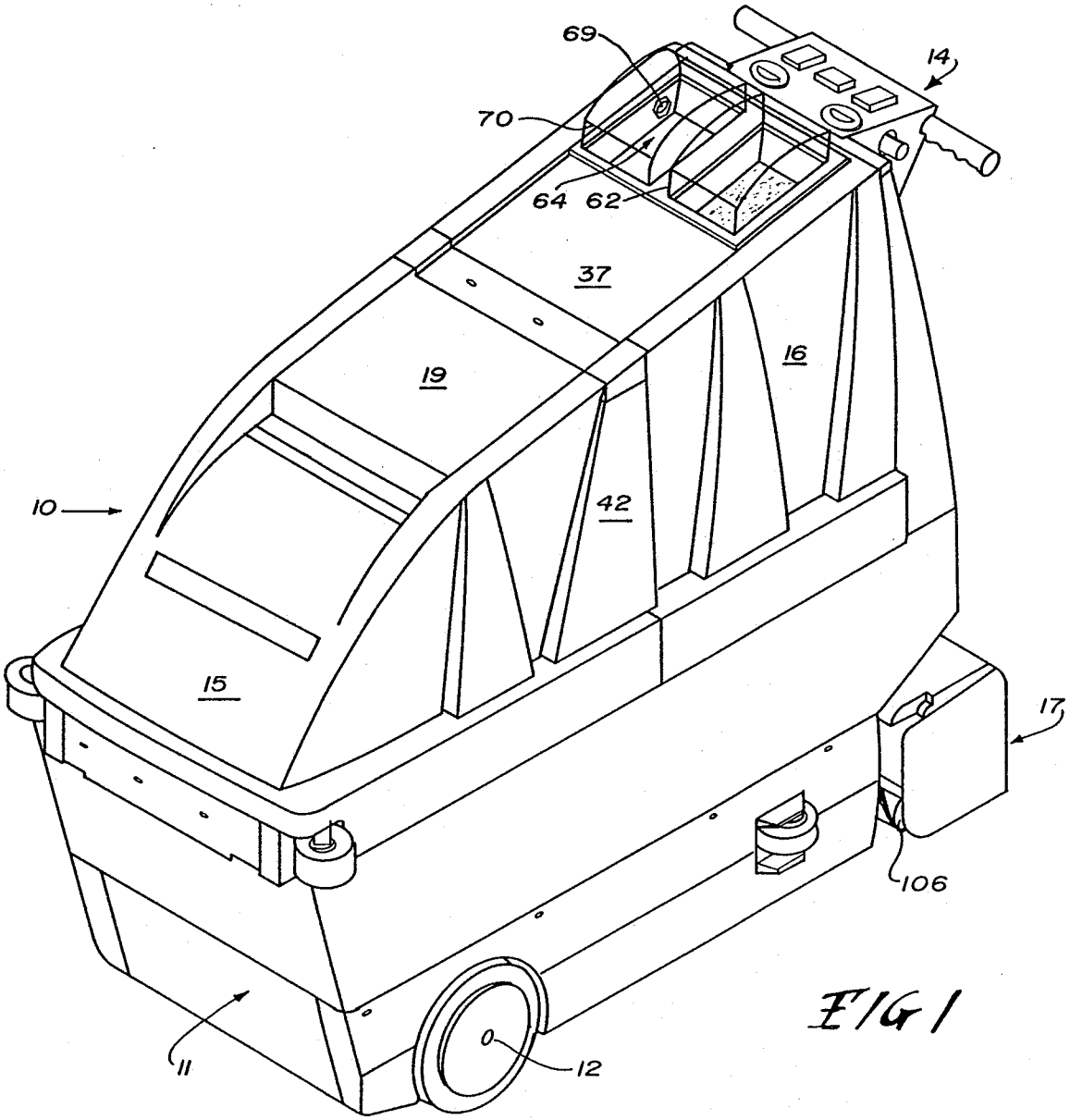
FIG. 1 is an upper frontal perspective view, taken from the left side, of a machine constructed according to the present invention.

Referring first to FIG. 1, a self-propelled scrubbing machine is seen from an upper, front perspective taken from the left side. As used herein, left and right refer to the left and right sides respectively of an operator standing behind the machine and looking in the direction of forward travel.

The overall machine includes an upper hull 10 for storage and a chassis or frame generally designated 11. Forward wheels 12 and rear wheels 13 (FIG. 2) support the chassis. An operator's handle and control generally designated 14 is located near the top and behind the hull.

The main hull 10 includes two separate housings secured together. A front housing 15 forms a reservoir or tank for a cleaning solution, and a rear housing 16 forms a reservoir for the spent or recovered solution.

The front and rear housings 15, 16 are mounted to and supported by the chassis 11. A scrub brush and vacuum recovery assembly generally designated 17 and briefly referred to as the "vacuum recovery assembly" is mounted behind rear wheels 13 at the base of the chassis 11.

Cleaning solution is poured through an upper inlet opening 18 in the solution tank which is defined by housing 15. The opening 18 is covered by a cover 19. The cleaning solution flows through an outlet 28 and feed line 29 to a pump 30 (see FIG. 2). The pump 30 feeds a line 32 which supplies the cleaning solution to a spray bar assembly generally designated 35 which is located behind the rear wheels 13 and extends across the width of the machine.

The rear housing 16 which forms the recovery tank has an upper access opening 36 which is covered by a cover 37. A flexible, molded pocket or boot, generally designated 44, is mounted between the two housings 15, 16 by suitable connecting flanges. For aesthetic purposes, a multi-piece cover 42 extends between the front and rear housings in FIG. 1 to hide the interconnection of the housings and boot. Additional details concerning the pocket 44 can be obtained from the co-owned, and co-pending application of Gary E. Palmer and Jerome E. Rau entitled "Improvements in Scrubbing Machine", Serial No. 109,925, filed 10/19/87, the disclosure of which is incorporated herein by reference in its entirety.

In brief, pocket 44 extends into the recovery tank when the solution tank is filled with clean solution to provide greater storage capacity for the clean solution than is available in the solution tank alone. Conversely, when the clean solution is used, and the amount of dirty solution increases in the recovery tank, the pocket inverts and extends into the solution tank to provide greater storage capacity for dirty solution, as more fully discussed in said co-pending application.

A plurality of storage batteries are carried by the chassis 11 in the area 54 for energizing the reversible drive motor 19 to move the machine in a forward or reverse direction, as determined by the operator's actions at control handle 14. Also mounted to the chassis 11 is a vacuum motor 55, the inlet of which communicates by means of a flexible conduit 56 with an upper plenum 57 in the rear portion of the housing 16, permitting the interior of the housing 16 to be maintained at a sub-atmospheric pressure (i.e., "vacuum"). The plenum 57 is a chamber which is defined at its upper part by a raised portion 62 of the rear cover 37. Vacuum conduit 56 is mounted to the bottom of plenum 57 by a nut 59. Above the vacuum opening are a screen and filter 63 which protect the vacuum opening from the entry of debris. An aperture in the left wall of plenum 57 communicates the interior of the plenum with the interior of the recovery tank housing 16, so the recovery tank is also under vacuum. As seen in FIG. 1, the raised portion 62 of the cover 37 may be made of a transparent plastic such as Plexiglass to seal the top of the plenum 57.

A similar plenum or recovery chamber 64 is formed in the top of housing 16 to the right of the vacuum plenum 57. The chamber 64 is a recovery chamber, and it communicates with a vacuum shoe generally designated 65 in FIGS. 2–5 by means of a conduit 66. The recovery shoe 65 has a suction inlet 67 at its bottom. An aperture 69 in the wall of recovery chamber 64 communicates the interior of the chamber with the recovery tank so that the vacuum in the recovery tank is communicated through the aperture 69, chamber 64 and conduit 66 to draw a vacuum in the vacuum shoe 65 and thereby recover the solution delivered by the spray bar 35 through suction inlet 67 after a brush, to be described, cleans the carpet with the solution.

The recovery chamber 64 is provided with a cover designated 70 in FIG. 1 to seal the recovery chamber and maintain the vacuum.

In operation, the vacuum motor 55 establishes a vacuum in the conduit 56 which is communicated to the plenum 57. The vacuum is in turn communicated through an aperture in the side of plenum 57 to the interior of the recovery tank 16 which is maintained under sub-atmospheric pressure. Similarly, the vacuum is communicated through the aperture 69 to the recovery chamber 64 which couples the negative pressure via flexible conduit 66 to the recovery vacuum shoe 65. Thus, spent cleaning solution is delivered from the recovery shoe 65 through the conduit 66 and into the recovery chamber 64. From the chamber 64, the spent solution is delivered through the aperture 69 and falls under gravity to the bottom of the recovery tank, but the dirty water does not enter the vacuum motor.

CHASSIS SUSPENSION

Figure 3:
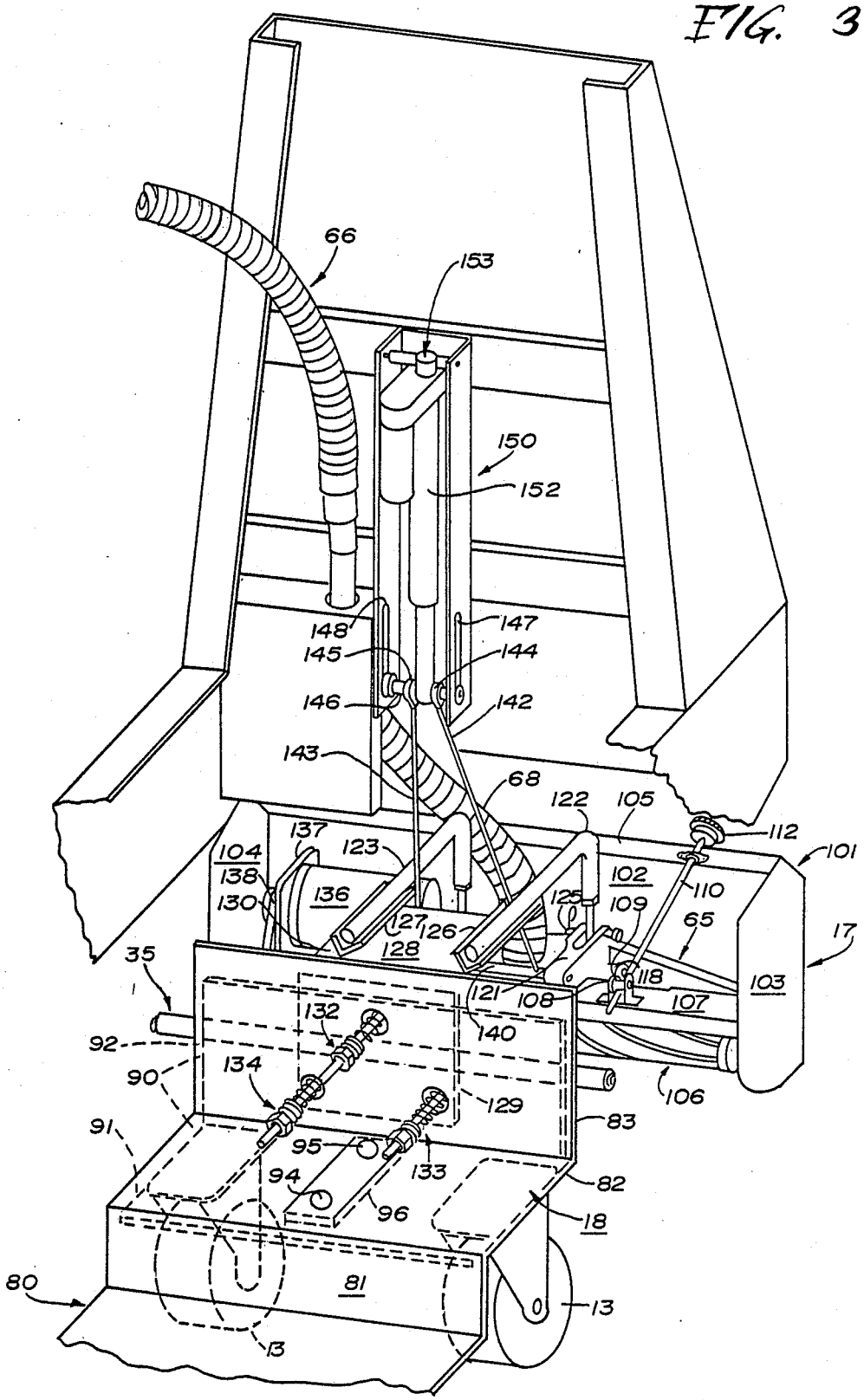
FIG. 3 is an upper frontal left side perspective view, of the lower rear portion of the machine showing the suspension system for the rear wheels and showing the brush and recovery assembly in the operating position.

Turning to FIG. 3 which is an upper left side perspective of the lower rear portion of the machine with the front and rear housings and side chassis panels removed, reference numeral 80 designates a bottom wall portion of the chassis 11. The bottom wall is then formed into a vertical portion 81 and a raised or horizontal portion 82, and finally a vertical rear wall 83. Mounted beneath the raised portion 82 of the chassis is the rear axle 18 which is a metal angle member generally designated 90 and having a horizontal portion 91 which is located beneath the horizontal raised portion 82 of the chassis, and a vertical portion 92 which is located behind the rear wall 83 of the chassis. The rear wheels 13 are welded to the bottom surface of the horizontal portion 91 of the rear axle 18. The axle is mounted to the horizontal portion 82 of the chassis by means of forward and rear mounting bolts 94, 95, and a resilient cushion member 96 is interposed between the bottom surface of the wall portion 82 and the top surface of the horizontal portion 91 of the axle. Thus, the bolts 94, 95 lie on the center line of the machine extending in a fore-and-aft direction, and this suspension system permits the rear axle 18 to rock slightly about a horizontal axis extending along the center line of the machine. This is advantageous in the event the machine traverses an uneven floor contour, in which case the axle 18 will rotate, slightly compressing one side of cushion member 96, and maintain all four support wheels in contact with the floor. This insures that the front drive wheels will always be in friction contact with the surface being cleaned while permitting a differential to be incorporated into the front axle, which is also the drive axle. The differential permits sharp turns of the machine, which is considered an important advantage under many use conditions encountered.

VACUUM RECOVERY ASSEMBLY

Figures 2, 4, 5:
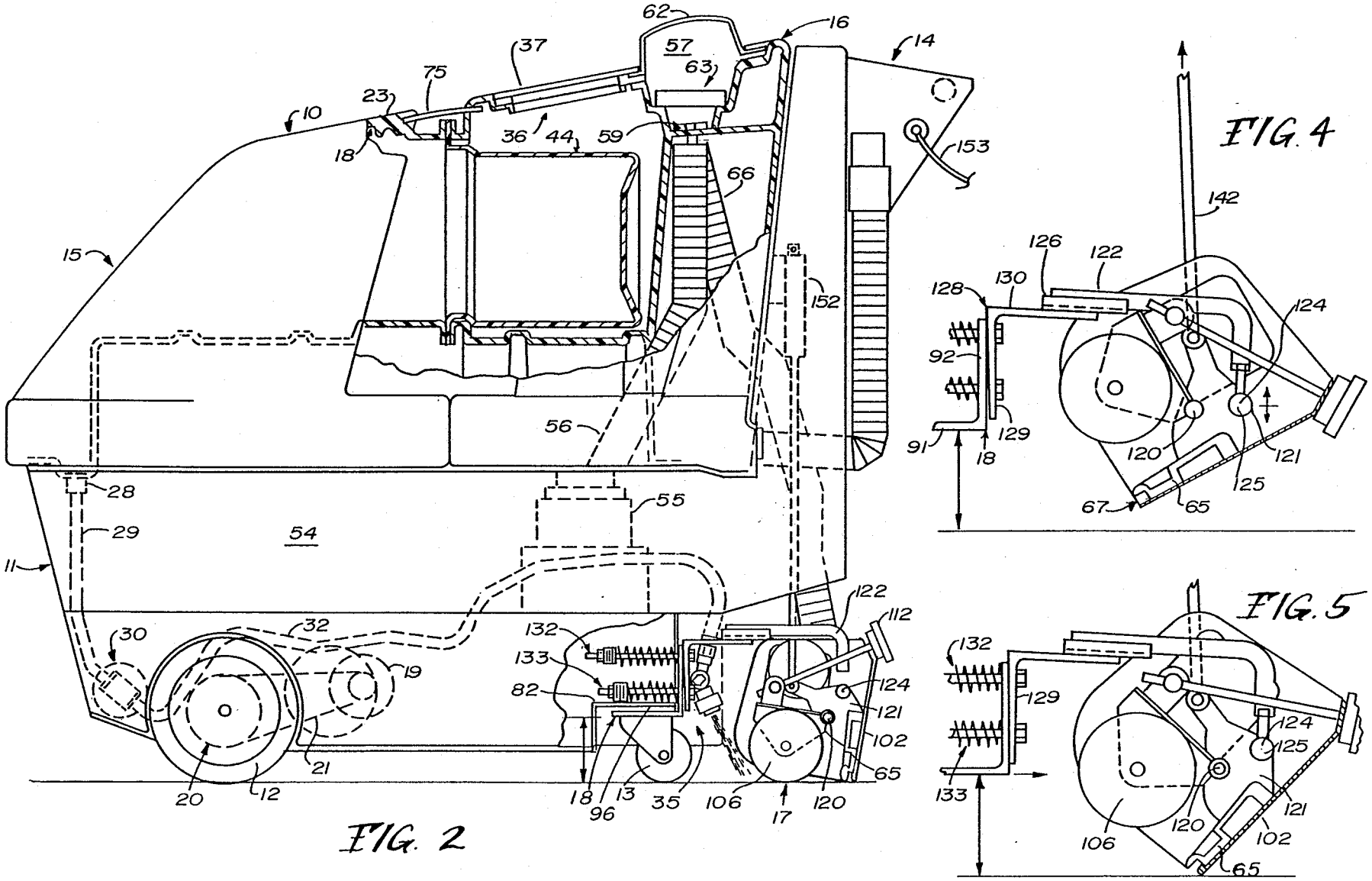
FIG. 2 is an elevational view taken from the left side of the machine of FIG. 1 with portions cut away to view the interior.
FIGS. 4 and 5 are diagrammatic left side views of the lower rear portion of the machine showing the vacuum recovery assembly in the transport mode and in the reverse mode respectively.

Referring to FIG. 3, the vacuum recovery assembly, previously identified by reference numeral 17, includes a rear mounting panel or guard 101 having a vertical rear wall 102, left and right side flanges 103, 104, and an upper flange 105 which extends upwardly and forwardly from the top of rear wall 102. The panel 101 is a shroud or guard for the spray assembly, brush and recovery vacuum shoe. As seen in FIG. 2, rear wall 102 provides the rear wall of the vacuum shoe 62.

Returning to FIG. 3, the scrub brush assembly includes, a cylindrical scrub brush 106 is mounted beneath a transverse support bar 107 which includes a pair of brackets 108 which support an internally threaded pivot pin 109 which receives a threaded rod 110. The upper rear portion of the threaded rod 110 is journaled in the upper flange 105 of the shroud 102 and includes an adjusting handle 112. The transverse bar 107 of the brush assembly includes a pair of mounting bosses, one of which is seen at 118, which is pivotally connected at 120 as seen in FIG. 2 to mounting ears 121 integrally formed in the vacuum shoe 65. The brush assembly may be adjusted relative to the vacuum shoe by turning the hand wheel 112. This rotates the brush assembly about pivot 120 and adjusts the height of the brush relative to the bottom of the vacuum shoe to accommodate carpets of different pile.

The vacuum shoe 65, as mentioned, includes two upper, forwardly extending ears, one of which is seen at 121. Both ears are pivotally mounted to L-shaped suspension arms 122, 123 for rotation about a common horizontal axis which extends transverse of the direction of travel of the machine and is designated 124 in FIGS. 2, 4 and 5. Pivot pin 125 couples ear 121 to arm 122 in FIG. 3. Arms 122, 123 are mounted by means of V-channels 126, 127 to the upper surface of a cushion mounting base 128. Base 128 is in the form of an angle and includes a vertical plate 129 (located immediately behind the vertical plate 92 of the rear axle 90 in FIG. 3), and an upper horizontal plate 130.

Referring to FIGS. 2 and 3, a set of three spring cushion mounts, identified respectively as 132, 133 and 134 each include a bolt having a head captured on the right side of the vertical plate 129 and extending through the vertical portion 92 of the rear axle 18 against which the springs of the cushion mounts seat. The mounts also extend through but do not co-act with rear wall 83 of the chassis. The vacuum recovery assembly is supported by the mounting base 128 and a cable lift system to be described presently.

The scrub brush 106 is driven by a motor 136 (FIG. 3) which is mounted to a bracket 137 welded to the top of the transverse bar 107 which supports the brush. The shaft of the motor 136 is coupled to the scrub brush 106 by means of a cogged belt 138.

The forward portions of the ears 121 on the vacuum shoe are connected together by means of a rod 140 as seen in FIG. 3; and a pair of flexible tension links in the form of cables 142, 143 are connected to the rod 140 at their lower ends. The upper ends of the cables 142, 143 are provided with collars 144, 145 respectively which are received on a transverse shaft 146, the ends of which are received in and adapted to slide along vertical slots 147, 148 respectively of a housing 150. The housing 150 mounts a linear actuator in the form of an electric screw 152, the rod end of which is connected to the shaft 146. The butt end of screw 152 is secured to the top of the housing 150 at 153. The electric screw 152 may be extended or retracted in a vertical direction. When the screw 152 is retracted, it draws the cables upwardly as it raises the rod 140 the vacuum shoe, as will be described presently.

OPERATION OF VACUUM RECOVERY SYSTEM

When it is necessary to transport the carpet scrubbing machine over a long distance, it is desirable to be able to do so under battery control, so the drive motor 19 which is actuated by the operator as he controls the handle and control assembly 14, is energized by storage batteries housed in the storage area 54. In the illustrated embodiment, as viewed in FIG. 2, when the handle gripped by the operator is rotated counterclockwise (that is, the top of the handle moves in a forward direction), the main drive motor 19 is energized by the batteries to drive the front wheels 12 and move the machine in a forward direction. Conversely, when the handle is rotated clockwise, the machine moves in reverse.

The machine is placed in the transport more by raising the brush and vacuum recovery assembly 17. To do so, the operator actuates the electric screw 152 which is energized by the batteries to raise the cables 142, 143. This causes the mounting ears 121 on the vacuum recovery shoe 65 to rotate clockwise about axis 124 via pivot pin 125 as seen in FIG. 4. It will be observed from FIG. 2 that in the normal position, the suction inlet 67 of the vacuum shoe is located behind the vertical plane containing the pivot axis 124. The linear actuator 152 has a limit in the use position so the cables 142, 143 are under tension and limit counterclockwise rotation of the shoe as seen in FIG. 2. The shoe is still free to rotate clockwise, however, about axis 124.

The cushion mounts 132, 133 and 134 create a downward bias on the brush and vacuum recovery assembly 17; and this force is transmitted through pin 125 and the corresponding pin connecting arm 123 to the shoe 65. It will be observed from FIG. 2 that the downward force is exerted at a location (axis 124 of pin 125) forward of the bottom of the recovery shoe 65 when the shoe is in its normal use position. Further, in the normal use position, the bottom of plate 129 is spaced slightly rearwardly of the vertical plate 92 o the rear axle 18 so the cushion mounts 133, 134 primarily provide the downward force which maintains the vacuum recovery assembly in the desired use position during operation. However, when the cables 142, 143 are drawn upwardly, the scrub brush 106 as well as the entire vacuum recovery assembly will rotate clockwise about axis 124. As the vacuum recovery assembly undergoes its initial upward movement, the arms 122, 123 and cushion base 128 will rock counterclockwise until the bottom of vacuum shoe 65 and rear wall 102 pass under the axis 124. As the cables are raised further, the vacuum recovery assembly will rotate clockwise further, and be raised to transport position shown in FIG. 4 against the force of the cushion mounts 133, 134.

When it is desired to return the vacuum recovery assembly to operation, the action of the electric screw 152 is reversed and the vacuum recovery assembly is lowered to the position shown in FIG. 5 with the bottom of the vacuum shoe resting on the carpet but forward of the axis 124. When the machine is then placed in forward motion, the lower part of the vacuum recovery shoe 65 will engage the carpet and the suspension system, including cushion base 128 will rock counterclockwise and the assembly will rotate counterclockwise about axis 124 to permit the assembly to rise slightly until the bottom of the vacuum recovery shoe 65 passes to the rear of axis 124. The assembly will continue to rotate until it is properly seated in the use position as seen in FIG. 2, but after the bottom of the shoe passes to the rear of axis 124, the cushion base 128 will rock slightly in a clockwise rotation.

As already described, the handle 112 and adjusting mechanism permit independent adjustment of the scrub brush 105 in the use position by rotating it about the pivot 120. Thus, once the scrub brush is adjusted in height relative to the vacuum shoe 65, and the assembly is placed in the use position of FIG. 2, the scrub brush will always return to the adjusted position relative to the carpet being cleaned.

When the operator desires to operate the machine in reverse, he rotates the handle of the control assembly 14 in a clockwise direction as viewed in FIG. 2, and this reverses the drive on the front wheels 12, causing the machine to move in reverse. Since, in the normal use position, the bottom of the recovery shoe 65 is behind the pivot axis 124 of the vacuum recovery assembly, the ushion base 128 and support arms 122, 123 will again rock slightly upwardly or counterclockwise (as viewed in FIG. 5) until the axis 124 passes over the bottom of the recovery shoe 65. Thereafter, the vertical plate 129 of the cushion base 128 will become bottomed against the vertical plate 92 of the rear axle 18, and the bottom of the recovery shoe (namely, the bottom of the rear wall 102) will be dragged along the carpet. Since the links 142, 143 are flexible, they permit the machine to move rearwardly without binding.

When the machine is then reversed to forward motion, the bottom of the vacuum shoe 65 will bind against the carpeting, the vacuum recovery assembly will rotate counterclockwise about axis 124, and the cushion base 128 will rock slightly as the axis 124 passes over the bottom of the recovery shoe until the assembly resumes the use position of FIG. 2, where, it will be observed, the bottom of the vertical plate 129 is spaced slightly from the bottom of the vertical plate 92. As mentioned above, this slight spacing between the cushion base 128 and vertical plate 83 in the normal position permits the brush and vacuum recovery system to remain spring-biased against the carpet, and maintains a constant pressure on the vacuum shoe against the carpet to promote recovery of the spent solution and to recover dirt more effectively.

One feature of having the links 142, 143 flexible is that if the machine encounters an irregularity in the contour of the floor, one side of the scrub head assembly may be raised relative to the other without damaging the mounting system.

Having thus described in detail a preferred embodiment of the invention, persons skilled in the art will be able to modify certain of the structure which has been illustrated and to substitute equivalent elements for those disclosed while continuing to practice the invention; and it is, therefore, intended that all such modifications and substitutions be covered as they are embraced within the spirit and scope of the appended claims.

I claim:

1. In a cleaning machine, the combination comprising: a chassis; support wheels for said chassis; dispensing means for applying a cleaning solution to a surface to be cleaned; vacuum recovery means for recovering spent solution from said surface and including a rigid recovery shoe having a rear edge; mounting means for mounting said vacuum recovery means to said chassis for pivotal movement about a horizontal axis between a use position in which said vacuum recovery means recovers spent solution from said surface and a reverse position in which said vacuum recovery means is rotated about said horizontal axis relative to said use position; spring means for exerting downward resilient force on said vacuum recovery means in said use position; said vacuum recovery means characterized in that when said vehicle is operated in a forward direction, said vacuum recovery means is in said use position and said spring means exerts said force thereon, and said vacuum recovery means is stable and operative for recovering spent solution, and when said vehicle is operated in a reverse direction, said rear edge of said vacuum recovery means catches on said surface and said vacuum recovery means is rotated forwardly about said horizontal axis against said spring force to said reverse position.

2. The apparatus of claim 1 further comprising means for limiting the downward movement of said recovery means relative to said chassis when said recovery means is rotated to said reverse position whereby said downward force is removed from said recovery means when said recovery means is in said reverse position.

3. The apparatus of claim 1 further comprising actuator means for raising said vacuum recovery means to an elevated transport position disengaging said surface for transporting said machinery.

4. The apparatus of claim 3 wherein said actuator means includes a linear actuator mounted to said chassis above said vacuum recovery means; and flexible link means connected between said linear actuator and said vacuum recovery means to raise said vacuum recovery means against the bias of said resilient means when said linear actuator is actuated in one direction, while permitting said vacuum recovery means to raise when said vacuum recovery means engages elevated areas in said surface.

5. The apparatus of claim 4 wherein said vacuum recovery means further comprises a cylindrical brush mounted for rotation about a horizontal axis parallel to the axis of rotation of said vacuum recovery means; means for driving said brush; said vacuum shoe means mounted being disposed behind said brush for recovering spent solution after said brush has cleaned said surface with said solution.

6. The apparatus of claim 1 wherein said machine is self-propelled and adapted to clean a carpet surface, said vehicle including forward wheels; rear wheels; a motor for driving said forward wheels; a rear axle for mounting said rear wheels to said chassis; and mounting means for securing said rear axle to said chassis including fastener means for mounting said rear axial to said chassis at a location proximate the center line of said machine, thereby permitting said rear axle to rock about a horizontal axis extending in the direction of travel of said machine; and a pad of resilient material interposed between said chassis and said axle whereby said rear axle may rock slightly relative to said chassis to permit said apparatus to pass over surfaces of uneven contour while maintaining all four wheels thereof in contact with said surfaces, said resilient material urging said axle to a predetermined position relative to said chassis.

7. The apparatus of claim 6 further means for raising said vacuum recovery means relative to said chassis including flexible link means connected to said vacuum recovery means permitting one side of said recovery means to be elevated relative to the other, whereby said recovery means may accommodate the contour of said surface independently of said rear axle and independently of the front driven wheels of said machine.

8. A floor scrubbing machine comprising: a chassis; support wheels for said chassis; dispensing means for applying a cleaning solution to said floor; rotating brush means for cleaning said floor with said solution; vacuum recovery means for recovery spent solution from said floor and including a rigid recovery shoe; mounting means for mounting said vacuum recovery means to said chassis for pivotal movement about a transverse horizontal axis between a use position in which said recovery shoe engages said floor behind a vertical plane passing through said transverse horizontal axis, and in which vacuum recovery means recovers spent solution from said floor, and a reverse position in which said vacuum recovery means is rotated about said transverse horizontal axis until said shoe is forward of said vertical plane; spring means for exerting downward resilient force on said vacuum recovery means; said vacuum recovery means characterized in that when said vehicle is operated in a forward direction, said shoe engages said floor and rotates said vacuum recovery means to said use position and said spring means exerts said force thereon, and said vacuum recovery means is stable and operative for recovering spent solution, and when said vehicle is operated in a reverse direction, said recovery shoe catches on said floor and said vacuum recovery means is rotated about said horizontal axis against said spring force forwardly of said vertical plane to said reverse position; and powered lift cable means for raising said vacuum recovery means to a transport position by lifting said recovery means at a location forward of said vertical plane thereby raising said recovery shoe out of engagement with said floor and rotating said recovery shoe forwardly of said vertical plane, said cable means limiting the lowered position of said vacuum recovery means in the use position.

* * * * *